US006085367A

United States Patent [19]

Guiste

[11] Patent Number: 6,085,367

[45] Date of Patent: Jul. 11, 2000

[54] BATHTUB LINERS

[76] Inventor: Judith Guiste, 1585 White Plains Rd., Apt. 5H, Bronx, N.Y. 10462

[21] Appl. No.: 09/020,769

[22] Filed: Feb. 9, 1998

[51] Int. Cl.[7] ..... A47K 3/02

[52] U.S. Cl. ..... 4/580; 4/546; 4/559

[58] Field of Search ..... 4/580, 581, 582, 4/583, 546, 559, 654, 655

[56] References Cited

U.S. PATENT DOCUMENTS

| | | | |
|---|---|---|---|
| 2,080,601 | 5/1937 | Cappuccio | 4/580 |
| 3,119,122 | 1/1964 | Weisbeck | 4/580 |
| 3,133,292 | 5/1964 | Spier | 4/580 |
| 4,051,563 | 10/1977 | Clarke | 4/173 R |
| 4,069,523 | 1/1978 | Ridgeway | 4/580 |
| 4,267,609 | 5/1981 | Altman et al. | 4/580 |
| 4,602,393 | 7/1986 | Fiveash | 4/580 |
| 4,630,323 | 12/1986 | Sage et al. | 4/580 |
| 4,956,882 | 9/1990 | Cohn | 4/580 |
| 5,715,546 | 2/1998 | Kvalvik | 4/580 |
| 5,742,955 | 4/1998 | Parkay et al. | 4/583 |

*Primary Examiner*—David J. Walczak
*Attorney, Agent, or Firm*—Milde, Hoffberg & Macklin, LLP

[57] ABSTRACT

A unitary bathtub liner comprised of:

a. a bottom section and four side sections that extend substantially to the top edge of the bathtub, the liner being capable of containing water;

b. the liner being comprised of a thermoplastic polymer of sufficient thickness that it is flexible enough to generally conform to the bathtub;

c. a device on the side of the liner that comes in contact with the bathtub for affixing the liner to the bathtub; and d. a drain that is located in the bottom of the liner in the relative location of a drain in the bathtub, said drain in the liner having a leak-resistant device for communicating with the drain in the bathtub.

38 Claims, 6 Drawing Sheets

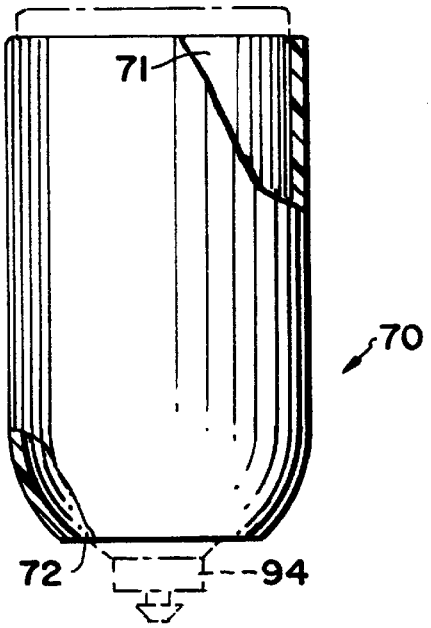
FIG.13
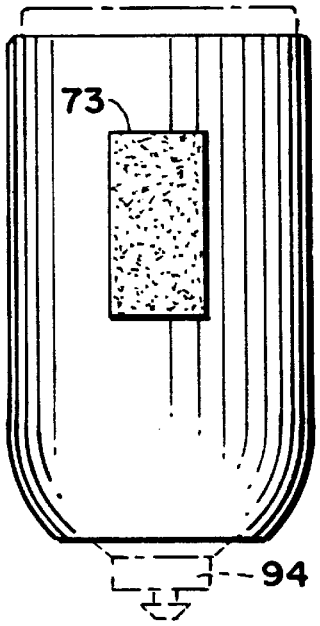
FIG.14
FIG.15
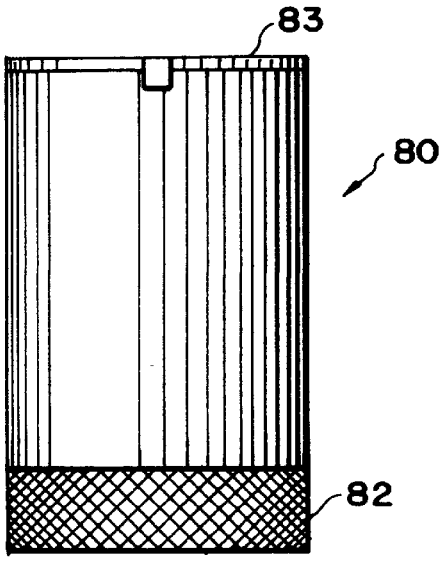
FIG.16
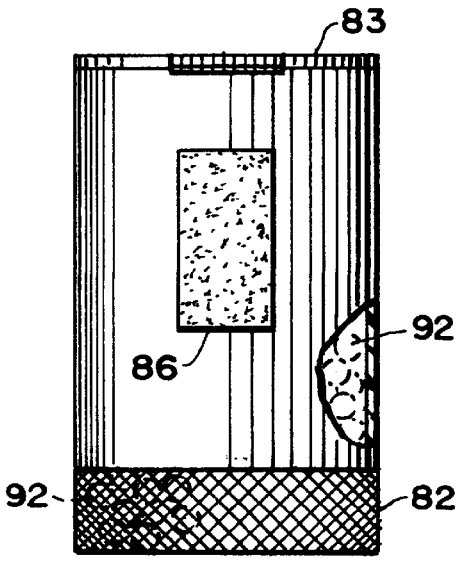

BATHTUB LINERS

This invention is concerned with plastic liners for bathtubs and more particularly to bathtub liners having padded surfaces and a non-slip top surface on their bottoms.

BACKGROUND OF THE INVENTION

The bathroom is the most dangerous place in the home for accidents. Bathtubs have hard, smooth surfaces that can become extremely slippery when wet. Each year hundreds of thousands of accidents are reported involving bathtubs. A bathtub liner is useful to prevent a bather from slipping, falling and consequently injuring himself.

Bathtub liners are known, e.g., from U.S. Pat. Nos. 4,602,393; 4,630,323; 4,956,882; and 4,051,563.

U.S. Pat. No. 4,602,393 discloses a bathtub liner that extends above the height of the bathtub into which it is inserted and that may be rolled up for storage. The inner surface of the liner is smooth, which is a safety hazard when the liner is wet. Neither the floor drain nor the overflow drain connections between the liner and the bathtub appear to be water-resistant or water-proof seals. This deficiency would allow stagnant water to collect between the liner and the bathtub and thereby promote the growth of pathogens such as bacteria and mildew.

U.S. Pat. Nos. 4,630,323 and 4,956,882 describe bathtub liners that are not capable of containing water within their confines. If the liner were to be kept in the bathtub, this deficiency would also allow stagnant water to collect between the liner and the bathtub and thereby promote the growth of pathogens such as bacteria and mildew.

U.S. Pat. No. 4,051,563 discloses a bathtub liner having chambers that are filled with water before use and then emptied after use. The patent states that "Where the liner includes a bottom portion, the rear portion may be a water filled cushion and the front part is preferably without cushioning and is textured to inhibit slipping when the bather stands in the tub." Apparently, the front portion is not water cushioned because the effect of water cushioning would be like standing on a water bed—extremely unstable.

U.S. Pat. No. 4,267,609 describes an accordion-pleated gasket assembly for coupling the drainage outlet openings of a bathtub and of a plastic liner installed within the bathtub. The coupling is quite complex and is apparently not leak-resistant because the gasket assembly is provided with a one-way valve for draining out the water that may accumulate in the space between the plastic liner bottom wall and the bottom wall of the bathtub.

SUMMARY OF THE INVENTION

It is an object of this invention to provide an improved durable bathtub liner for permanent or semipermanent use in a bathtub.

It is another object of this invention to provide an improved portable bathtub liner that may be folded up and taken with one when traveling.

It is a further object of this invention to provide an adjustable bathtub liner that can be adapted to fit bathtubs of different sizes and shapes.

It is a still further object of this invention to provide an improved bathtub liner with a non-skid surface that is safe to stand on.

It is yet another object of this invention to provide a padded surface in the bathtub liner for the user's safety and comfort.

It is another object of this invention to provide a sanitary bathtub liner that is microbial resistant or microbial proof.

These and other objects are achieved according to the present invention by providing an improved a unitary bathtub liner comprised of:

a. a bottom section and four side sections that extend substantially to the top edge of the bathtub, said liner being capable of containing water;

b. said liner being comprised of a thermoplastic polymer of sufficient thickness that it is substantially self-supporting and yet flexible enough to generally conform to the bathtub;

c. means on the side of the liner that comes in contact with the bathtub for affixing the liner to the bathtub; and d. a drain that is located in the bottom of the liner in the relative location of a drain in the bathtub, said drain in the liner having leak-resistant means for communicating with the drain in the bathtub.

The invention also comprises a portable, foldable bathtub liner comprised of:

a. a bottom section and four side sections that extend substantially to the top edge of the bathtub, said liner being capable of containing water;

b. said liner being comprised of an impermeable flexible film of a thermoplastic polymer of sufficient thickness that it is substantially durable;

c. means on the side of the liner that comes in contact with the bathtub for affixing the liner to the bathtub; and d. a drain that is located in the bottom of the liner in the relative location of the drain in the bathtub, said drain in the liner having leak-resistant means for communicating with the drain in the bathtub.

The bathtub liners of the invention are capable of containing water within their confines when either a stopper is placed in the drain in the bottom of the liner or the drain in the bathtub is closed. Either version of the bathtub liners of the invention may be padded.

BRIEF DESCRIPTION OF THE DRAWINGS

FIG. 13 illustrates partially in cross-section the bath oil holder of the embodiment shown in FIG. 10.

FIG. 14 is a view of the back side of the bath oil holder shown in FIG. 13.

FIG. 15 illustrates a bath beads holder of the embodiment shown in FIG. 10.

FIG. 16 is a view partially in cross section of the back side of the bath beads holder shown in FIG. 15.

DESCRIPTION OF THE PREFERRED EMBODIMENTS

Figure 1:
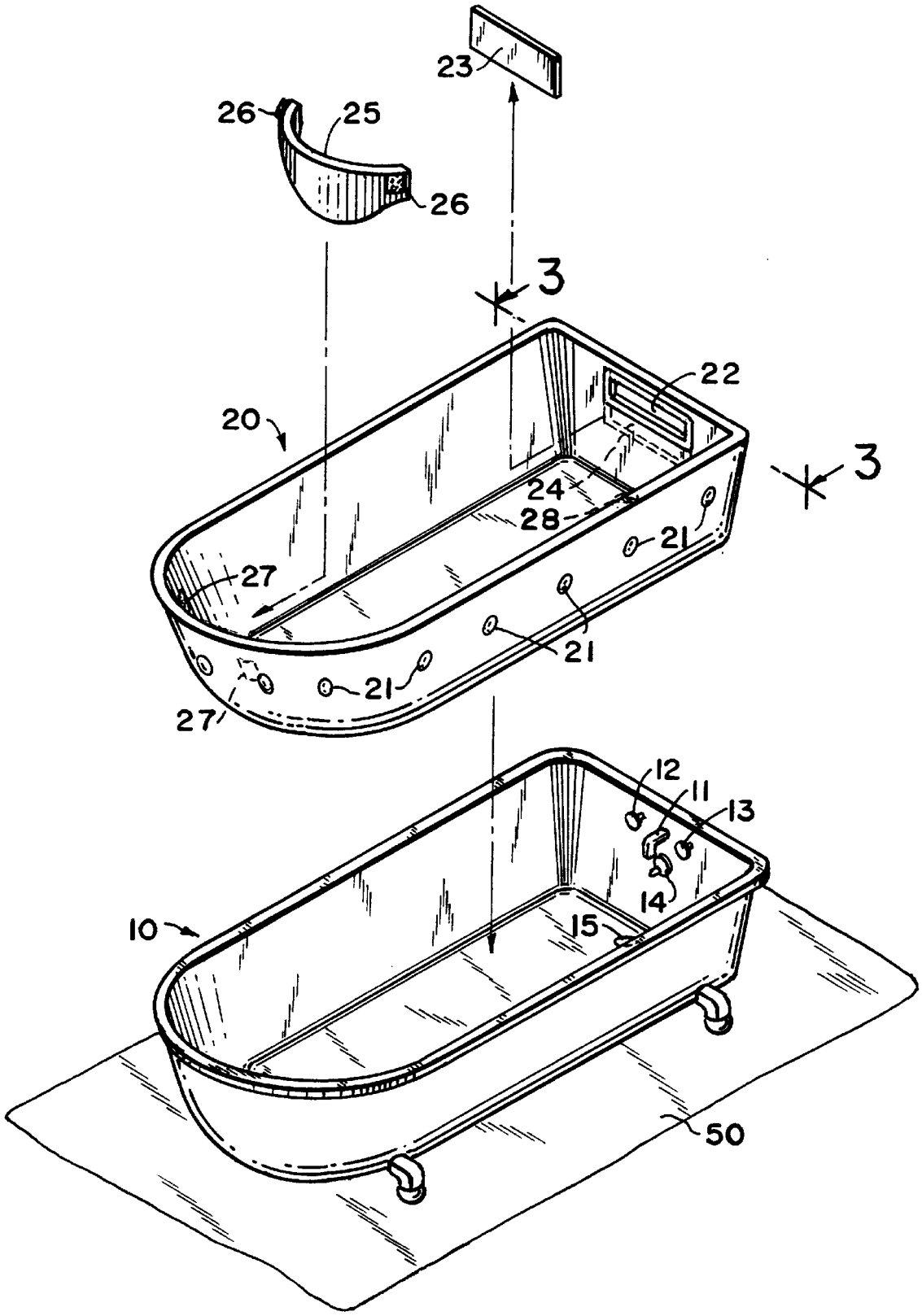
FIG. 1 is an exploded perspective view of one embodiment of the durable permanent or semi-permanent liners of the invention, shown over a bathtub into which it fits.

FIG. 1 is an exploded perspective view of one embodiment of the durable liners 20 of the invention, shown over the bathtub 10 into which it fits. Bathtub 10 rests on floor 50. At the right end of the bathtub 10 are faucet 11, hot and cold water valves 12 and 13, drain control and overflow drain 14 and floor drain 15. Liner 20 is surrounded by suction cups 21 for affixing the liner 20 to the bathtub 10. Suction cups 21 could instead be pressure-sensitive adhesive spots temporarily protected by release paper until the liner is placed in the bathtub. To provide access 22 to the faucet 11, hot and cold water valves 12 and 13 and drain control and overflow drain 14, a tear off panel 23 is provided. Shown in dashed lines below access area 22 is an additional tear-off panel 24 to be torn off if needed to provide additional access 22 to the faucet 11, hot and cold water valves 12 and 13 and drain control and overflow drain 14. Where the hardware on a bathtub 10 does not require access through the liner 20, then the tear off panels 23 and 24 are not torn off and consequently the integrity of the liner is not breached. Head rest 25 is provided with hook or loop (preferably loop) adjustable fastening means 26, e.g., Velcro® fasteners, for positioning the headrest 25 at the correct height for the intended user by one's pressing the adjustable fastening means 26 onto the other part of the loop or hook (preferably hook) fastening means 27 on the bathtub liner 20. Shown in dashed line is drain 28 in liner 20 which is aligned with and communicates with the floor drain 15 in the bathtub 10. The thickness of permanent or semipermanent liner 20 may range from about 0.05 to about 0.20 inches.

Figure 2:
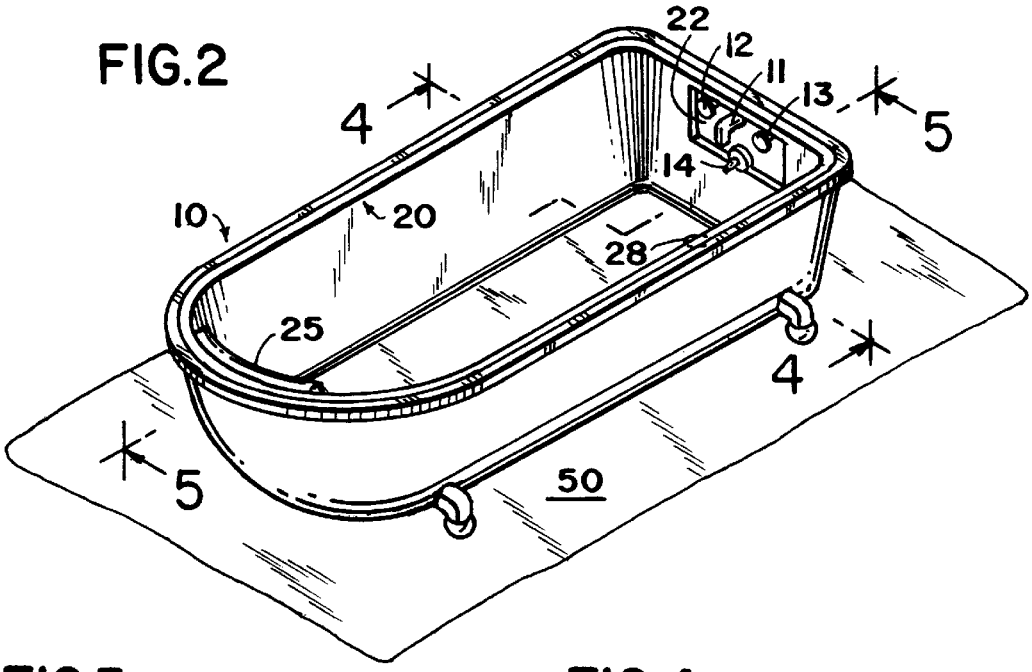
FIG. 2 is a perspective view of the liner shown in FIG. 1 fitted into the bathtub.

FIG. 2 is a perspective top view of the liner 20 shown in FIG. 1 as fitted into the bathtub 10. The reference numerals have the same meanings as given in the preceding paragraph.

Figure 3:
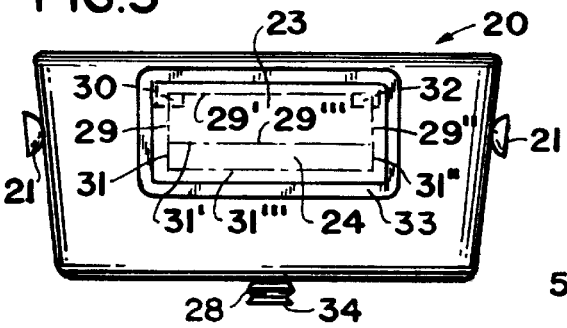
FIG. 3 is an end view of the of the liner shown in FIG. 1 taken from the vantage point of line 3—3 shown in FIG. 1.

FIG. 3 is an end view of the of the liner 20 shown in FIG. 1 taken from the vantage point of line 3—3. Suction cups or alternatively pressure-sensitive adhesive spots 21 are used to affix the liner to the bathtub 10. Tear-off panel 23 has tear line 29–29'–29"–29'" along which panel 23 is designed to tear off when pull tab 30 or 32 is pulled. Shown below tearoff panel 23 is additional tear-off panel 24 which has tear line 31–31'–31"–31'" along which panel 24 is designed to tear off. Preferably, surrounding tear-off panels 23 and 24 is a suction ring 33, i.e., a concave ring of thermoplastic polymer or rubber, which instead may be a band of pressure-sensitive adhesive, which may be initially protected by a release paper until the liner is positioned in the bathtub. Preferred flexible, extendable and compressible, accordion-pleated drain 28 in liner 20 is aligned with and communicates with the floor drain 15 in the bathtub 10. At the bottom edge of drain 28 is a means 34 for making leak-resistant or leak-proof communication with the floor drain 15 in bathtub 10. The means 34 may be a ring of pressure-sensitive adhesive, but preferably it is a suction ring, i.e., a concave ring of thermoplastic polymer or rubber.

Figure 4:
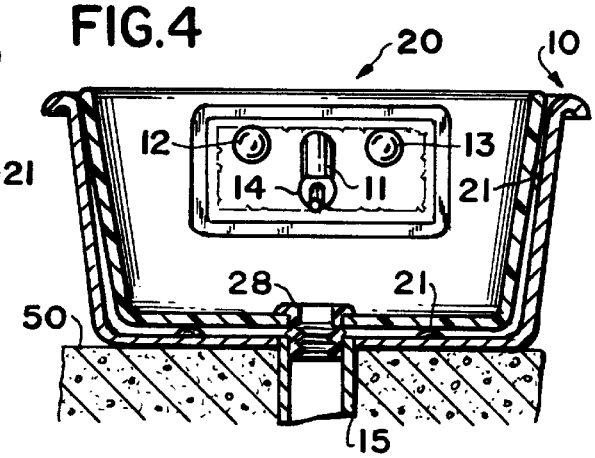
FIG. 4 is a transverse cross-section of the liner and bathtub shown in FIG. 2 taken along the line 4—4 shown in FIG. 2.

FIG. 4 is a transverse cross-section of the liner and bathtub shown in FIG. 2 taken along the line 4—4. The reference numerals have the same meanings as given above. In this view, the grate (not shown) over the floor drain 15 in bathtub 10 has been removed and the bottom end of a drain 28 in the liner 20 is inserted into the floor drain 15 in bathtub 10. When the drain 28 in liner 20 is intended for use by insertion in the floor drain 15 in bathtub 10, it may instead be a straight piece of tubing of appropriate length to fit within the floor drain 15.

Figure 5:
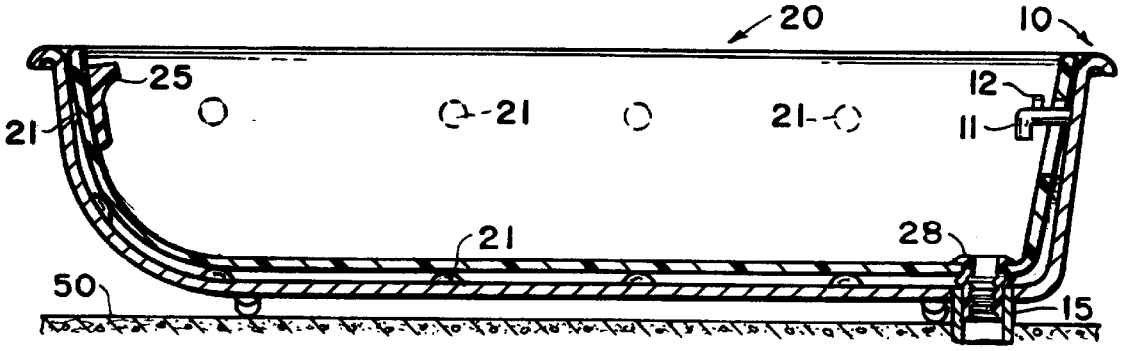
FIG. 5 is a longitudinal cross-section of the liner and bathtub shown in FIG. 2 taken along the center line 5—5 shown in FIG. 2.

FIG. 5 is a longitudinal cross-section of the liner 20 and bathtub 10 shown in FIG. 2 taken along the center line 5—5. The reference numerals have the same meanings as given above.

Figure 6:
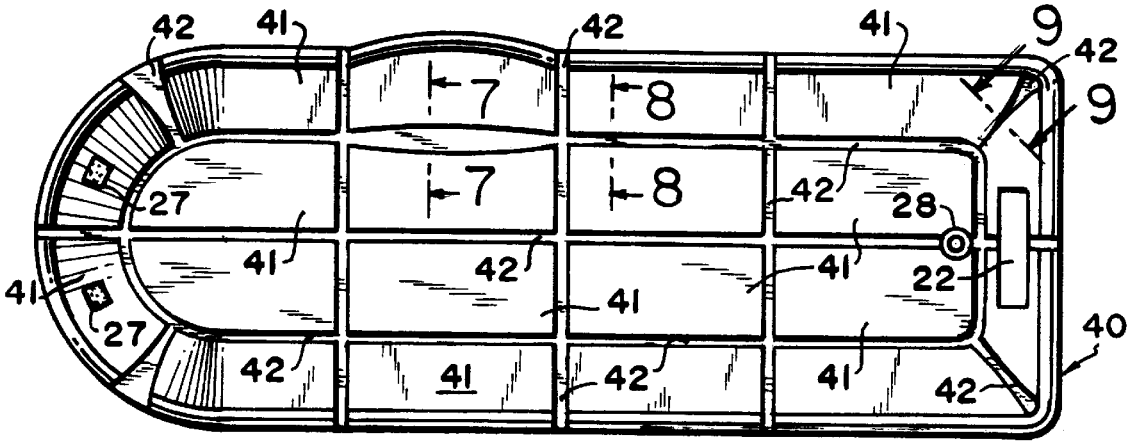
FIG. 6 is a top view of another embodiment of the invention, a portable, foldable bathtub liner.

FIG. 6 is a top view of another embodiment, a portable, foldable bathtub liner 40 of the invention. The liner 40 is preferably comprised of padded areas 41 alternated with thinner web sections 42. The other reference numerals have the same meanings as given above.

Figure 7:
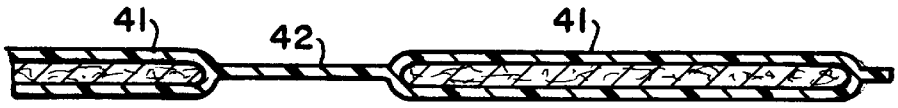
FIG. 7 is a transverse cross-section of the embodiment shown in FIG. 6 taken along the line 7—7 shown in FIG. 6.
Figure 8:
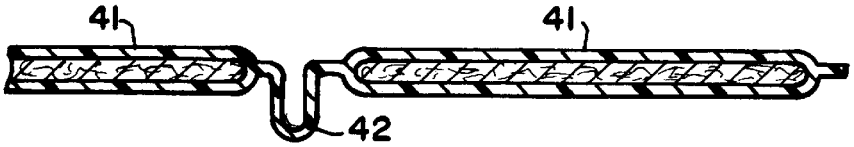
FIG. 8 is a transverse cross-section of the embodiment shown in FIG. 6 taken along the line 8—8 shown in FIG. 6.
Figure 9:
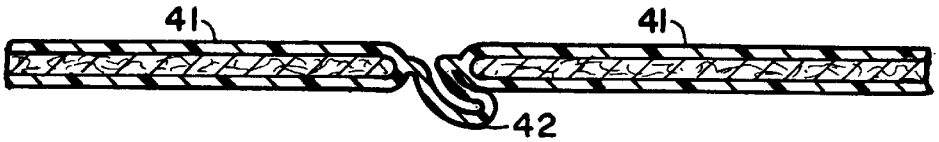
FIG. 9 is a cross-section of the embodiment shown in FIG. 6 taken along the line 9—9 shown in FIG. 6.

FIG. 7 is a transverse cross-section of the embodiment shown in FIG. 6 taken along the line 7—7. It shows the web section 42 at that point in its extended position. FIG. 8 is a transverse cross-section of the embodiment shown in FIG. 6 taken along the line 8—8. It shows the web section 42 at that point in its partially folded position. FIG. 9 is a cross-section of the embodiment shown in FIG. 6 taken along the line 9—9. It shows the web section 42 at that point in its folded-under position. By means of these possible positions of the thinner web sections 42, one is enabled to adjust the liner 40 to fit almost any bathtub. In addition, the thinner web sections 42 allow for the padded liner to be folded relatively flat and compact. To fold the liner 40, it may be first folded up longitudinally along the center web section, then folded down along each of the other longitudinal web sections 42. Thereafter, it may be folded up and alternately down along each successive transverse web section 42. The web sections 42 should be sufficiently wide that they can accommodate the multiple thicknesses of the folded padded sections 41 and yet result in a relatively flat folded liner 40.

Figure 10:
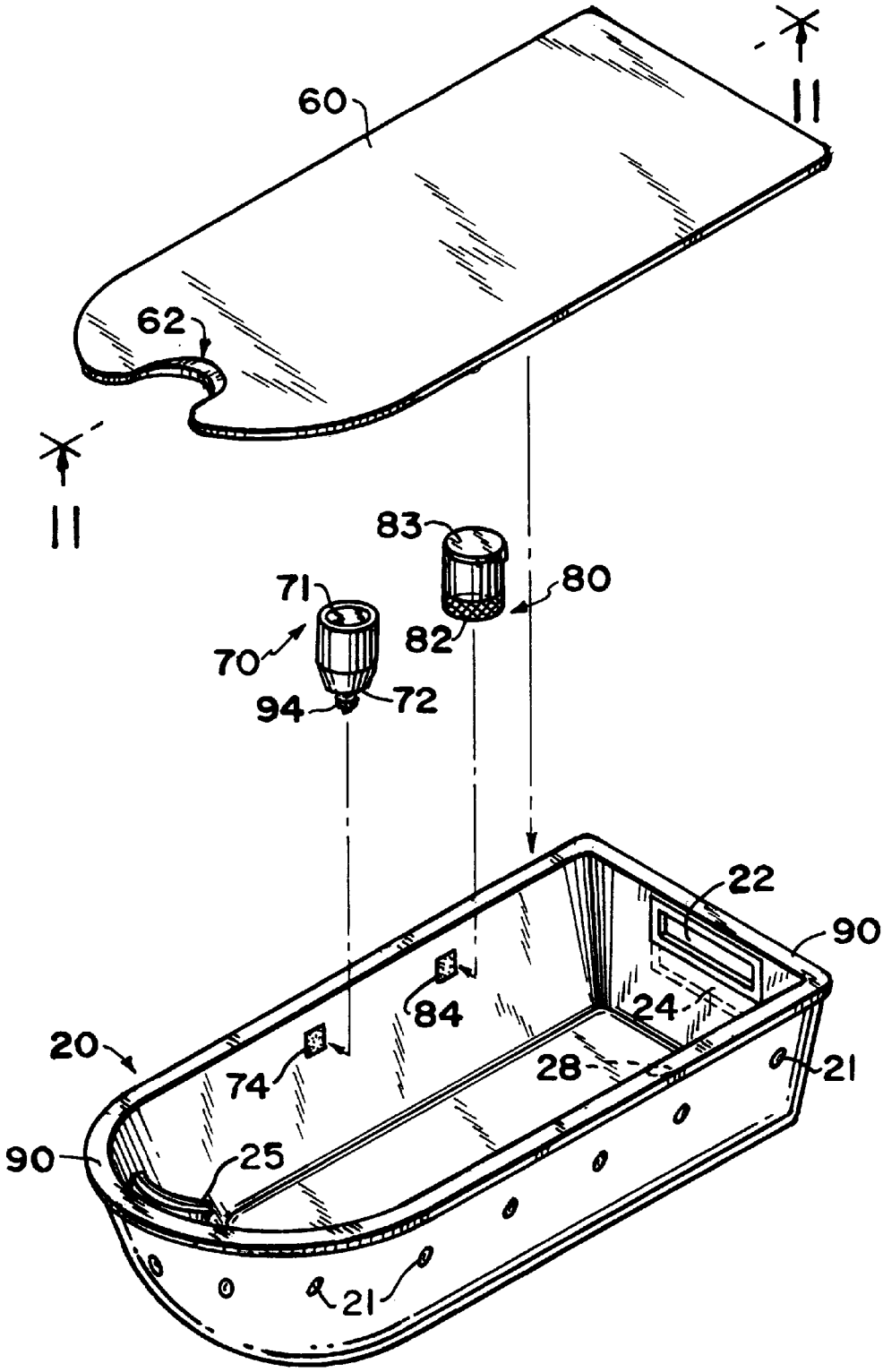
FIG. 10 is an exploded perspective view of one embodiment of the durable permanent or semi-permanent liners of the invention, which includes a cover and bath oil and bath beads holders.

FIG. 10 depicts a variation of the liner shown in FIG. 1, wherein the reference numerals 20 to 28 have the same meanings as described in connection with FIG. 1. FIG. 10 is an exploded perspective view of one embodiment of the durable permanent or semi-permanent liners of the invention, which includes a cover 60 that functions to insulate the water contained in the liner 20 in the bathtub and to provide a steam bath atmosphere to the bather in the tub. Liner 20 has a lip 90 that at least partly covers the rim of the bathtub. Cover 60 is adapted for adjustment by means of a tear out piece 62 in order to accommodate the individual user's needs or desires. Also illustrated in FIG. 10 are optional bath oil bottle holder 70 and bath beads holder 80. Bath oil holder 70 is shown holding inverted bath oil bottle 71. The bath oil bottle 71 is prevented from dropping out of the bath oil bottle holder 70 by the narrow bottom section 72 of the bath oil bottle holder 70, which serves to support the bottle by its shoulder. The bottom of the bath oil bottle holder 70 is open to allow the user to use the dispenser 94 of the bottle 71 and thereby release some of the bath oil into the bath water. The bath oil bottle holder 70 is preferably releasably attachable to the liner 20 any convenient means, e.g., a hook and loop fastener, such as a Velcro® fastener. One part of such a fastener 74, either the hook or loop part, is illustrated on the liner 20. Bath beads holder 80 has a mesh section 82 at its bottom to allow the beads to dissolve in the bath water when the bath water is above the bottom section 82 and also to allow the water to run out of the holder 80 when the bath water is drained from the liner 20 in the tub. The bath beads holder 80 has a hinged lid 83 to cover the bath beads. The bath beads holder 80 is preferably releasably attachable to the liner 20 any convenient means, e.g., a hook and loop fastener, such as a Velcro® fastener. One part of such a fastener 84, either the hook or loop part, is illustrated on the liner 20.

Figure 11:
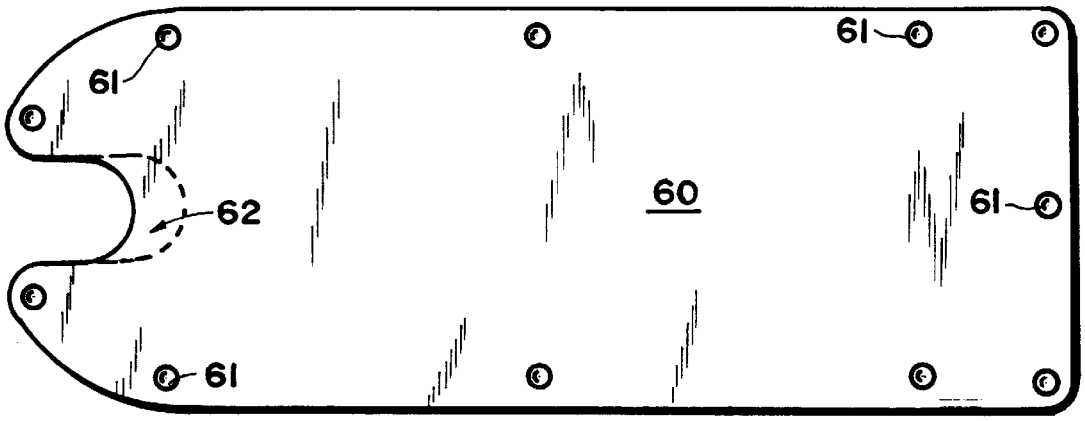
FIG. 11 is a bottom view of the cover shown in FIG. 10.

FIG. 11 is a bottom view of the cover 60 shown in FIG. 10. Suction cups 61 around the perimeter serve to releasably hold cover 60 to the lip 90 of liner 20 inserted in the bathtub 10. Preferably, the cover 60 is made from plastic-coated fabric, e.g., nylon or polyester fabric, in order to prevent excessive sagging in its span across the bathtub liner 20. Section 62 is a tear out piece to allow the user to adjust the neck opening.

Figure 12:
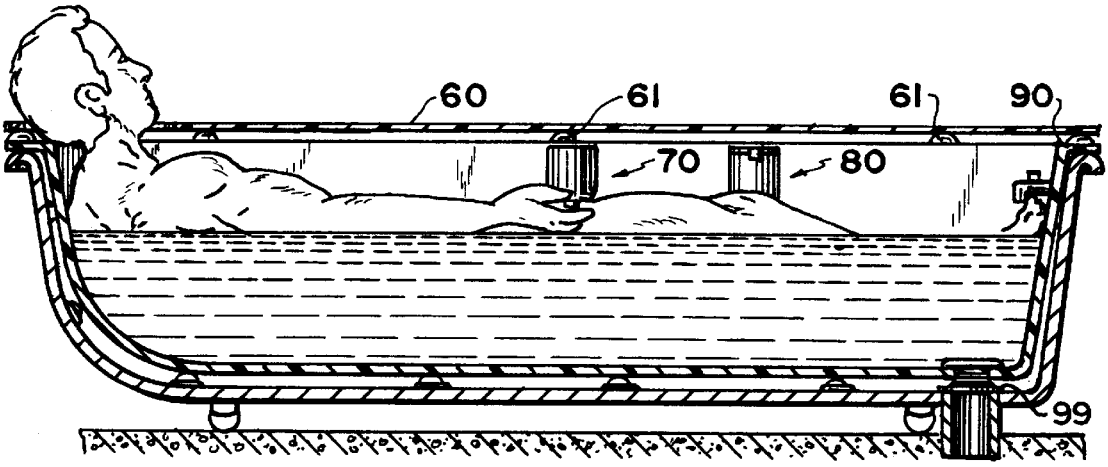
FIG. 12 is a longitudinal cross-section of the embodiment shown in FIG. 10 taken along the centerline.

FIG. 12 is a longitudinal cross-section of the embodiment shown in FIG. 10 taken along the center line 5—5 as shown in FIG. 2. Depicted in FIG. 12 is a bather in the water in the liner in the bathtub. The cover 60 is shown in place around the bather's neck. The cover 60 is releasably attached to the lip 90 of the liner 20 by suction cups 61. The bather is shown dispensing some bath oil from the bath oil bottle 71 held in the bath oil bottle holder 70. Also shown is bath beads holder 80. In FIG. 5, the drain 28 in the liner 20 is inserted in the floor drain 15 in bathtub 10 after the grate over floor drain 15 has been removed. In FIG. 12, in contrast, the grate 99 is left in place and the drain in the liner is compressed and the suction ring at its bottom perimeter is used to make a leak-resistant seal with the perimeter of the grate 99.

FIG. 13 illustrates partially in cross-section the bath oil holder 70 of the embodiment shown in FIG. 10. The holder 70 is shown holding bath oil bottle 71, which is held in place by the narrow section 72. Dispenser 94 of bath oil bottle 71 is available through the bottom of holder 70.

FIG. 14 is a view of the back side of the bath oil holder 70 shown in FIG. 13. One part of a hook and loop fastener 73, either the hook or loop, is attached to the back of the bath oil bottle holder 70 to allow the bath oil bottle holder to be releasably attached to the bathtub liner 20 by means of the other part of the hook-and-loop fastener 74 shown in FIG. 10.

FIGS. 15 and 16 illustrate the bath beads holder 80 of the embodiment shown in FIG. 10. The reference numerals 80, 82 and 83 have the same meanings as given above in connection with FIG. 10. FIG. 16 is a view partially in cross section of the back side of the bath beads holder shown in FIG. 15. Bath beads 92 are contained in holder 80 by the mesh bottom 82. One part of a hook and loop fastener 86, either the hook or loop, is attached to the back of the bath beads holder 80 to allow the bath beads holder to be releasably attached to the bathtub liner.

Another preferred embodiment of the invention is an economical, disposable liner that looks like the liners depicted in FIGS. 1 or 10. It differs from the other liners of the invention in that it is made of thinner gauge plastic, e.g., about 3 to 5 mils, and does not have many of the optional features of the other liners. To further economize the liner may utilize adhesive spots of its back side to adhere it to the bathtub instead of the more costly suction cups.

It is preferred that the top surface of the bottoms of the liners be non-skid. They may be roughened or textured to provide a frictional engagement surface for an individual within the bathtub. It is preferred that the surface be ridged. Preferably, the ridges are so positioned that they direct the water toward the floor drain when the stopper is lifted. It is also preferred that the liners of the invention include padding for the user's safety and comfort.

The bathtub liners may be constructed from any suitable thermoplastic polymer, e.g., a polyethylene, polypropylene, polybutylene, polyester, polyamide, polyurethane or polyvinyl chloride or a blend or a copolymer thereof. The method of forming the bathtub liners of the invention may be any suitable and convenient method of manufacture. For example, the permanent liners may be made by injection molding, by rotomolding or by assembly of preformed parts, e.g., by use of adhesives, by thermal fusion of the parts, or by sonic welding of the parts. The portable version of the bathtub liners may be made by film extrusion, by casting, or by assembly of preformed parts, e.g., by use of adhesives, by thermal fusion of the parts, or by sonic welding of the parts. The padded versions of the liners may be formed by having suitably sized preformed foam panels encapsulated between two sheets of plastic film by heat sealing the two sheets of plastic film around the perimeters of the foam panels. Alternatively, the padded versions may be made by causing a polymer, e.g., a polyurethane, to foam inside a mold. In another alternative, the padding may be formed of entrapped air in sealed sections of the liner. The padded sections of the liners may range from about 0.125 to about 0.5 inches.

Many older bathtubs no longer have smooth surfaces because of wear and the use of abrasive cleansers on their surfaces. Because of the porosity of their surfaces, it is difficult to clean and sanitize these older bathtubs. Consequently, the liners of the invention, which are easy to clean and are either mildew-resistant or mildew-proof, are convenient and inexpensive additions that eliminate the problems inherent in old bathtubs. The fold-up bathtub liner and the disposable bathtub liner of the invention are particularly convenient for the traveler who fears the pathogens that may lurk unforeseen in a less than sanitary bathtub in a hotel or motel. The sanitary liners of the invention give one a great degree of assurance against the bacterial or yeast infections that might otherwise be contracted with an unsanitized bathtub. Such assurances are of particular importance for infants, children and older people. In nursing homes, where several residents may have to use the same bathtub, it is a simple matter to have a separate liner for each resident and to place each resident's liner in the bathtub before use.

The addition of an antimicrobial agent in the liner should minimize or eliminate the incidence of opportunistic infections. If the plastic liners of the invention are found to be insufficiently mildew resistant, it is preferred that a mildewcide or mildewstat be either topically applied to the side of the liner that comes in contact with the bath water or be incorporated into the polymer before forming the liners. Any suitable mildewcide or mildewstat may be used. Illustrative of topically applied mildew control agents are P-180-D™ (Clear Shield, Mexico Beach, Fla.), which molecularly bonds to surfaces and will not wash off; DURA LAST MOLD, MILDEW & ALL PURPOSE CLEANER for up to one year protection; DURA LAST MOLD, MILDEW & ODOR PROTECTANT for up to three years of protection (both products available from D.C. Marine Products, W. Lynn, Mass.); or BIOFINISH™ (BIOSHIELD, Powell, Ohio). For long-lasting antimicrobial protection of the liners of the invention, it is preferable to incorporate the antimicrobial agent by blending it in the polymer. Illustrative of the antimicrobial agent that may be blended into the polymer are polyvalent metal compounds, particularly polyvalent organometallic compounds. Illustrative of such compounds are the tin compounds, particularly the organotin compounds, e.g., triacetin. Also useful as antimicrobial agents that may be blended with the polymer are the organocholoro compounds, e.g., triclocarban. Microban Products Company (Huntersville, N.C.) has developed technology based on the active ingredients in antibacterial soaps so that these active ingredients can be incorporated into all types of plastics to provide resistance to the growth of bacteria, molds and fungi. The company reports that the antimicrobial protection lasts for the life of the product.

The foregoing specification and the accompanying FIGS. have thus described and shown a novel improved bathtub liner which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A unitary bathtub liner comprised of:

a. a bottom section and four side sections that extend substantially to the top edge of the bathtub, said liner being capable of containing water;

b. said liner being comprised of a thermoplastic polymer of sufficient thickness that it is substantially self-supporting and yet flexible enough to generally conform to the bathtub;

c. means on the side of the liner that comes in contact with the bathtub for affixing the liner to the bathtub; and d. a drain that is located in the bottom of the liner in the relative location of a drain in the bathtub, said drain in the liner being an accordion-pleated tube with a suction ring at its bottom edge capable of making a leak-resistant seal with thc drain in the bathtub.

2. A bathtub liner as claimed in claim 1 wherein means for affixing the liner to the bathtub are suction cups.

3. A bathtub liner as claimed in claim 1 wherein the thermoplastic polymer is a polyethylene, polypropylene, polybutylene, polyester, polyamide, polyurethane or polyvinyl chloride or a blend or a copolymer thereof.

4. A bathtub liner as claimed in claim 1 wherein the liner ranges in thickness from about 0.05 inches to about 0.2 inches.

5. A bathtub liner as claimed in claim 1 wherein the interior of the liner is padded.

6. A bathtub liner as claimed in claim 5 wherein the padded sections of the liner range from about 0.125 inches to about 0.5 inches.

7. A bathtub liner as claimed in claim 1 wherein a tear-out panel is present at the end of the liner adjacent to a faucet, water valves, drain control and overflow drain of the bathtub, which tear-out panel may be torn out to allow access through the liner to the faucet, water valves, drain control and overflow drain of the bathtub.

8. A bathtub liner as claimed in claim 7 wherein around the perimeter of the tear-out panel adjacent to the tub there is present leak-resistant means for sealing the liner at that point to the bathtub.

9. A bathtub liner as claimed in claim 8 wherein the leak-resistant means for sealing the liner to the bathtub around the perimeter of the tear-out panel adjacent to the bathtub is a suction ring.

10. A bathtub liner as claimed in claim 1 wherein the top surface of the bottom of the liner is non-skid.

11. A bathtub liner as claimed in claim 1 wherein the top surface of the bottom of the liner has non-skid ridges.

12. A bathtub liner as claimed in claim 1 wherein the drain connection that communicates between the liner and the bathtub is a tube.

13. A bathtub liner as claimed in claim 1 wherein an antimicrobial agent is additionally present in the thermoplastic polymer.

14. A bathtub liner as claimed in claim 1 wherein an adjustable headrest is additionally present in the liner.

15. A bathtub liner as claimed in claim 14 wherein the headrest is adjustable by means of a hook and loop fastener, one part of which is present on the liner and the other part of which is present on the headrest.

16. A bathtub liner as claimed in claim 1 wherein there is present at the top of the liner a lip that extends around at least part of the rim of the bathtub in which it is fitted.

17. A bathtub liner as claimed in claim 16 wherein there is fitted across the top of the liner a cover with a cutout section to allow a bather's neck and head to protrude above the cover, said cover being releasably affixed to the lip of the liner.

18. A bathtub liner as claimed in claim 17 wherein the cover is releasably affixed to the lip of the liner by means of suction cups on the bottom side of the cover.

19. A portable, foldable bathtub liner comprised of:

a. a bottom section and four side sections that extend substantially to the top edge of the bathtub, said liner being capable of containing water;

b. said liner being comprised of an impermeable, flexible film of a thermoplastic polymer of sufficient thickness that it is substantially durable;

c. means on the side of the liner that comes in contact with the bathtub for affixing the liner to the bathtub; and d. a drain that is located in the bottom of the liner in the relative location of the drain in the bathtub, said drain in the liner being an accordion-pleated tube with a suction ring at its bottom edge capable of making a leak-resistant seal with the drain in the bathtub.

20. A bathtub liner as claimed in claim 19 wherein the means for affixing the liner to the bathtub are suction cups.

21. A bathtub liner as claimed in claim 19 wherein the thermoplastic polymer is a polyethylene, polypropylene, polybutylene, polyester, polyamide, polyurethane or polyvinyl chloride or a blend or a copolymer thereof.

22. A bathtub liner as claimed in claim 19 having sections of padding in the majority of its area with thinner webs surrounding the sections of the padding and also at the corners where the side sections meet and where the side sections meet the bottom section, which thinner webs may be extended or folded under to adjust the size of the liner to the size and shape of the bathtub and may be used to fold the liner for storage or transport.

23. A bathtub liner as claimed in claim 22 wherein the padded sections of the liner range from about 0.125 inches to about 0.5 inches.

24. A bathtub liner as claimed in claim 22 wherein the web sections of the liner range from about 5 mils to about 25 mils.

25. A bathtub liner as claimed in claim 19 wherein the drain that communicates between the liner and the bathtub is an accordion-pleated tube with a suction ring at its bottom edge that is capable of making a leak-resistant seal with the drain in the bathtub.

26. A bathtub liner as claimed in claim 19 wherein an antimicrobial agent is additionally present in the thermoplastic polymer.

27. A bathtub liner as claimed in claim 19 wherein a tear-out panel is present at the end of the liner adjacent to a faucet, water valves, drain control and overflow drain of the bathtub, which tear-out panel may be torn out to allow access through the liner to the faucet, water valves, drain control and overflow drain of the bathtub.

28. A bathtub liner as claimed in claim 27 wherein around the perimeter of the tear-off panel adjacent to the tub there is present leak-resistant means for sealing the liner at that point to the bathtub.

29. A bathtub liner as claimed in claim 28 wherein the leak-resistant means for sealing the liner to the bathtub around the perimeter of the tear-off panel adjacent to the bathtub is a suction ring.

30. A bathtub liner as claimed in claim 19 wherein an adjustable headrest is additionally present in the liner.

31. A bathtub liner as claimed in claim 30 wherein the headrest is adjustable by means of a hook and loop fastener, one part of which is present on the liner and the other part of which is present on the headrest.

32. A disposable bathtub liner comprised of:

a. a bottom section and four side sections that extend substantially to the top edge of the bathtub, said liner being capable of containing water;

b. said liner being comprised of an impermeable, flexible film of a thermoplastic polymer;

c. means on the side of the liner that comes in contact with the bathtub for affixing the liner to the bathtub; and d. a drain that is located in the bottom of the liner in the relative location of the drain in the bathtub, said drain in the liner being an accordion-pleated tube with a suction ring at its bottom edge capable of making a leak-resistant seal with the drain in the bathtub.

33. A bathtub liner as claimed in claim 32 wherein the means for affixing the liner to the bathtub are adhesive areas.

34. A bathtub liner as claimed in claim 32 wherein the thermoplastic polymer is a polyethylene, polypropylene, polybutylene, polyester, polyamide, polyurethane or polyvinyl chloride or a blend or a copolymer thereof.

35. A bathtub liner as claimed in claim 32 wherein the thickness of the liner is in the range of from about 3 mils to about 5 mils.

36. A bathtub liner as claimed in claim 32 wherein a tear-out panel is present at the end of the liner adjacent to a faucet, water valves, drain control and overflow drain of the bathtub, which tear-out panel may be torn out to allow access through the liner to the faucet, water valves, drain control and overflow drain of the bathtub.

37. A bathtub liner as claimed in claim 36 wherein around the perimeter of the tear-out panel adjacent to the tub there is present leak-resistant means for sealing the liner at that point to the bathtub.

38. A bathtub liner as claimed in claim 37 wherein the leak-resistant means for sealing the liner to the bathtub around the perimeter of the tear-out panel adjacent to the bathtub is a ring of adhesive.

* * * * *